US005829920A

United States Patent [19]

Christenson

[11] Patent Number: 5,829,920

[45] Date of Patent: Nov. 3, 1998

[54] METHOD OF TESTING WRAPPED SUBMERGED PILING FOR INFESTATION

[76] Inventor: John Christenson, 585 Midwood Ave., Brick, N.J. 08724

[21] Appl. No.: 841,363

[22] Filed: Apr. 14, 1997

[51] Int. Cl.[6] ..... E02D 5/60

[52] U.S. Cl. ..... 405/216; 52/101; 405/211

[58] Field of Search ..... 405/216, 232, 405/233, 211; 52/101, 170, 514

[56] References Cited

U.S. PATENT DOCUMENTS

| | | | |
|---|---|---|---|
| 3,390,951 | 7/1968 | Finger et al. | 405/216 X |
| 4,918,883 | 4/1990 | Owen et al. | 52/101 |
| 5,175,973 | 1/1993 | Owen et al. | 405/216 X |
| 5,326,410 | 7/1994 | Boyles | 405/216 X |
| 5,516,236 | 5/1996 | Williams et al. | 405/216 |

*Primary Examiner*—Dennis L. Taylor
*Attorney, Agent, or Firm*—Clifford G. Frayne

[57] ABSTRACT

A method and apparatus to determine whether or not wrapping of submerged timber or wood piling is efficacious in preventing infestation of the submerged timber or wood which includes a self-contained test kit which permits the testing of the wrapping of the submerged timber or wood pilings to determine whether or not infestation from marine microorganisms or marine borers is continuing despite the wrapping. A sample of the alleged stagnate water between the wrapping and the piling is taken for testing for oxygen content, temperature, and ph, without denigrating the integrity of the wrapping.

13 Claims, 3 Drawing Sheets

METHOD OF TESTING WRAPPED SUBMERGED PILING FOR INFESTATION

BACKGROUND OF THE INVENTION

1. Field of Invention

This invention relates to a method and apparatus for testing submerged wooden structures, such as wood pilings, for attack by marine organisms, such as marine borers, the invention prolongs the life and serviceability of submerged pilings and the like.

2. Description of the Prior Art

Wooden pilings have been used for many years to support piers, wharfs, boat slips, and in some instances, older bridges. It is well known that such piling is subject to many hazards necessitating the replacement of same. One major source of damage, which drastically shortens the life expectancy of the piling is the attack on the piling by certain marine parasites and microorganisms. These marine microorganisms feed upon the cellulose material of the wood piling extracting a food substance of a polysaccharide carbohydrate nature.

Particular marine microorganisms known to attack wooden pilings include limnoria, gribbles and teredo microorganisms. The teredo begins life as a larvae and begins it metamorphosis into an adult when it has attached itself to the surface of a piece of submerged timber. The teredo will begin burrowing into the submerged timber and its tail appendage will seal off the entry way. The only visible presence of a teredo is the occurrence of two microscopic syphon tubes, one for the inhalation of fresh water and the other for exhalation. In its boring, the teredo will dispose of waste through the exhalation syphon and the inhalation syphon is designed to produce continuously circulating water over the teredo's gills for the absorption of oxygen. New larvae is also disposed of through the exhalation syphon to infest the same submerged timber or other timber. The specific danger with the teredo is that the submerged timber pile appears to be secure and intact, when in fact the interior of the pile may contain a great deal of infestation.

The second marine borer, of the limnoria species, which is sometimes referred to as a gribble, resembles lice and is about the size of a small ant and it is capable of boring holes of approximately 3 mm in diameter. The limnoria rarely penetrate the timber for more than 10 to 12 millimeters, but they normally infest in great numbers on the outer layer of the submerged timber such that the submerged timber takes on a honeycombed appearance with tiny individual channels. This attack combined with the eroding effects of the sea's tide will break down the surface of the wood and expose new surfaces for attack.

Previous efforts to safeguard these hazards include the impregnation of the structures and/or the coating of their surfaces with special preservatives and protective coatings using materials such as creosote, tar and impervious paints. While these materials do cover certain hazards, they are in ineffective with respect to others and the chemical treatments are subject to leeching, scaling and erosion by the action of the constantly moving surrounding water, taken together with temperature changes and shock forces. Further, the high salinity and other constituents of sea water also contribute to degradation of these protective measures.

Various guard devices have been proposed for installation about pilings to solve the infestation problem. One prior art protective measure involved enclosing portions of the piling in direct contact with the water with a sheet of plastic by wrapping the sheet tightly around the pile. The piling has also been encased with rigid polyvinyl chloride tubing. This method proves a barrier to access by marine life not readily present in or on the piling and traps that life present in and on the pilings inside the jacket. The intent of the wrapping is to trap a thin layer of water between the wrapping and the wooden pile and to prevent that thin film from being refreshened by fresh sea water. This water, becoming stagnate, is rapidly depleted of oxygen and thus deprives the marine life of the vital gas and arrests further damage to the piling. The Applicant has found while this preventative measure works in theory, in actual practice, a great majority of the wraps do not prevent the refreshening of the water trapped between the wrapping and the pile and thus the infestation continues.

Bell, in U.S. Pat. No. 4,983,072 proposed a method of protecting submerged pilings in which the wrap was enhanced by filing the space between the wrap and the piling with a water insoluble filler material, comprised of either sand or silt. While this process may enhance the deprivation of oxygen to the marine infestation, it is cumbersome and if the wrap is penetrated, the sand or silt may be washed away from the piling.

Applicant's invention is directed towards an apparatus and method in the form of a test kit which can be used to determine whether or not heretofore wrapped solutions for submerged wood or timber have the efficacy to deny the submerged wood or timber access to oxygenated water to prevent infestation in the form of marine microorganisms and marine borers.

OBJECTS OF THE INVENTION

An object of the present invention is to provide for a novel method and apparatus in the form of a test kit to determine whether or not the heretofore wrapping of submerged timber is efficasious in preventing infestation of the submerged timber or wood.

A still further object of the present invention is to provide for a novel test kit which can be utilized in either a submerged state or on the surface of the water to test the wrapping of submerged timber or wood for determination of infestation of marine microorganisms or marine borers.

A still further object of the present invention is to provide for a novel test kit and method for testing wrapped submerged timber or wood pilings for infestation by marine microorganisms or marine borers.

A still further object of the present invention is to provide for a novel method and apparatus in the form of a test kit for identifying wrapped, submerged, timber or pilings which have continued infestation from marine microorganisms or marine borers.

SUMMARY OF THE INVENTION

The present invention is comprised of a self-contained test kit which permits the testing of the wrapping of submerged timber or wood pilings to determine whether or not infestation from marine microorganisms or marine borers is continuing despite the wrapping. The method and apparatus comprising a test kit for withdrawing a sample of the alleged stagnate water between the wrapping and the piling for testing for oxygen content, temperature, and ph, without denigrating the integrity of the wrapping, and dependant upon the readings thereof, the introduction of a dye into the stagnate circumferential water trapped between the wrapping and the piling and the viewing or filming of the egress of the dye from the circumferential area to determine whether or not fresh sea water has gained or is gaining access to the circumferential area to support the infestation of marine microorganisms or marine borers.

BRIEF DESCRIPTION OF THE DRAWINGS

These and other objects of the present invention will become evident, particularly when taken in light of the following illustrations wherein.

DETAILED DESCRIPTION OF THE DRAWINGS

Figure 1:
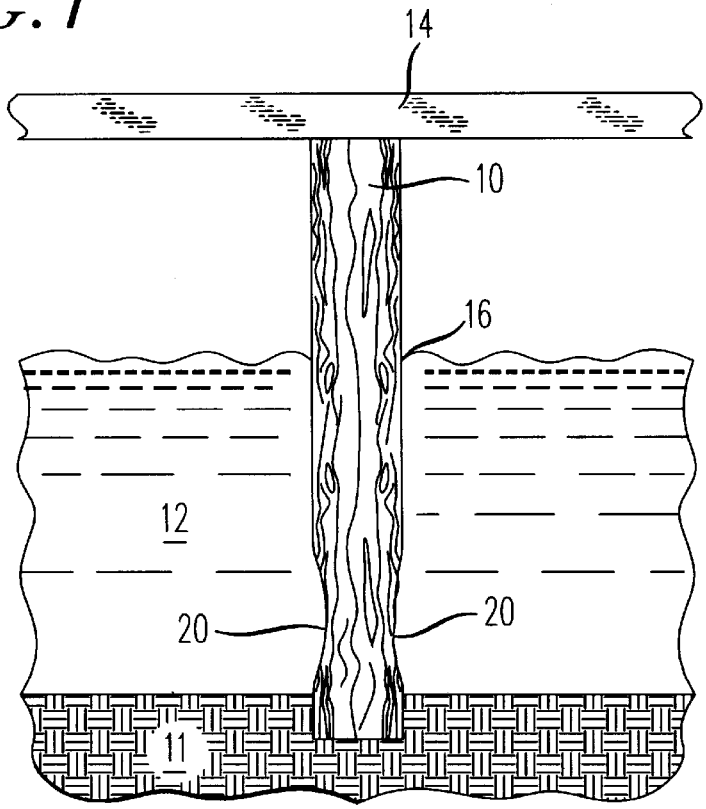
FIG. 1 is a side view illustration of a typical submerged timber or wooden pile which has been subjected to marine infestation as a result of marine microorganisms or marine borers.

FIG. 1 illustrates a side view of a typical piling in position which has suffered the infestation of marine microorganism and marine borers. The typical pile 10 has been driven into the silt or sandy bottom 11 of the ocean or salt water estuary 12 to a sufficient depth to provide stability and a pier, bulkhead or other structure 14 has been constructed on top of the piling 10. The piling 10 comprises a normally generally cylindrical member which is subjected to attack from the ambient atmosphere above the high tide point 16 and the action of the tide of the salt water ocean or estuary below high tide point 16. It is the area below the high tide mark 16 which suffers from the infestation attack of microorganisms or micro borers. In FIG. 1, there is illustrated a typical attack from the microorganism or micro borer limnoria, which attacks the submerged portion of the timber or wood pile 10 in great numbers and causes the honeycomb or hourglass effect which is not normally visible to the observer above the surface of the water. This attack can reduce the supporting strength of the wooden or timber pile by as much as 15% per year if gone untreated. In this particular infestation attack, it can be seen that the piling has undergone severe deterioration 20 proximate its lower end to the extent such that the pier or structure which the pile is supporting is in grave danger. If this attack were to occur on a sufficient number of adjoining pilings, any structure on the pier 14 supported by the piling 10 would present a dangerous situation not only for the structure, facility, but also the individuals who work or travel therethrough.

While the result of the infestation illustrated in FIG. 1 is shown proximate to the silt or sandy base 11 of the ocean or estuary 12, the infestation and resultant weakening of the piling could occur anywhere along the longitudinal axis of the piling that is repetitively positioned below the high tide mark 16.

Figure 2:
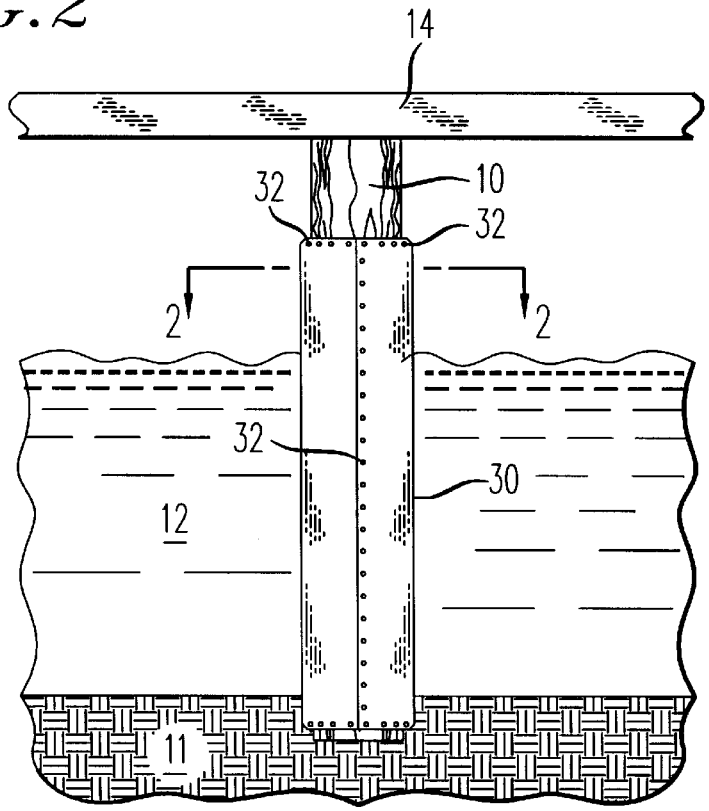
FIG. 2 is a side view illustration and representation of the manner in which a wrap is utilized to protect the encapsulated, submerged, wooden or timber pile from infestation.

FIG. 2 illustrates a piling with a wrapping secured thereabout as taught in U.S. Pat. No. 3,027,610 to O. E. Ladell and U.S. Pat. No. 4,983,072 to Bell, Jr., with variations. Ladell would perform the wrapping to provide a stagnant water area between the wrapping 30 and the outer circumference of the piling 10 so as to deprive the marine microorganisms and marine borers from oxygen. Bell would provide a similar wrapping albeit of different structure, combined with a filler between the inner circumference of the wrapping 30 and the outer circumference of the piling 10.

The problem associated with each of the aforesaid solutions is verifying the integrity of the wrapping, the possibility of a defect or cut in the wrapping and the loss of filler material, and the manner in which the wrapping is secured to the piling to ensure that a stagnant layer of water is entrapped between the wrapping and the piling to ensure the cut off of oxygen supply to the marine borers and therefore the death or stoppage of their infestation.

Heretofore, it has been assumed that a wrapping resulted in the entrapment of a stagnant film or layer of water between the wrapping and the piling that would perform as advertised, namely, the prevention or denial to the marine microorganism or micro borer of oxygen, thus causing the death of the marine microorganism or marine borer. Such has not always been the case and therefore the need for the development of a method and apparatus in the form of a test kit to determine whether or not the wrapping is performing as advertised and desired.

In most instances, the wrapping 30 is comprised of a flexible sheet of UV-resistant material of an approximate thickness of 3 mm which can be sealed about the submerged wooden or timber piling by wrapping it about same, and securing it to the piling around the upper and lower, generally circular ends thereof by fasteners 32 or ring clamps as taught by Bell or Ladell, and along the longitudinal seam 34 thereof, by nails 32 or other suitable material. It is thought that this securing means would effectively isolate the submerged portion of the wooden or timber pile from fresh, oxygenated salt water. In normal installation, the lower end of the wrap would be secured about the piling below the silt or sand bottom 11 of the ocean or estuary 12 and the upper portion would be secured about the timber or wood piling sufficiently above the high tide mark 16 such that it would insure that the salt water would never rise above the wrapping. In this configuration, the wrapping was designed to provide a stagnant annular circumferential layer of water 36 in FIG. 3 about the piling which would deny the marine microorganism or marine borer oxygen within which to survive.

Applicant's apparatus and method and test kit allows for the testing of such wrapped timbers so as to determine whether or not they are operating in their intended capacity and with their intended efficacy without violating their intended integrity and also allows for the determination of where leaks or points of egress of fresh salt water are allowed if the integrity has been violated.

The apparatus, method and test kit determines whether or not the oxygen content of the alleged stagnant layer of annular, circumferential water 36 is sufficient to support marine life and in particular marine borers. Secondary tests include temperature of the alleged stagnant annular circumferential layer and the ph.

Figure 3:
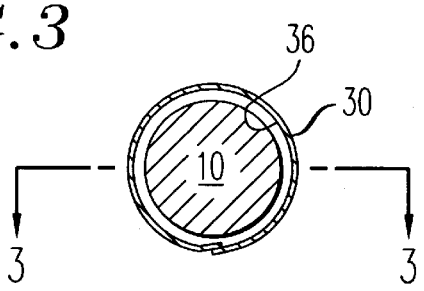
FIG. 3 is a top view along plane 2—2 of FIG. 2 of a wrapped piling.
Figure 4:
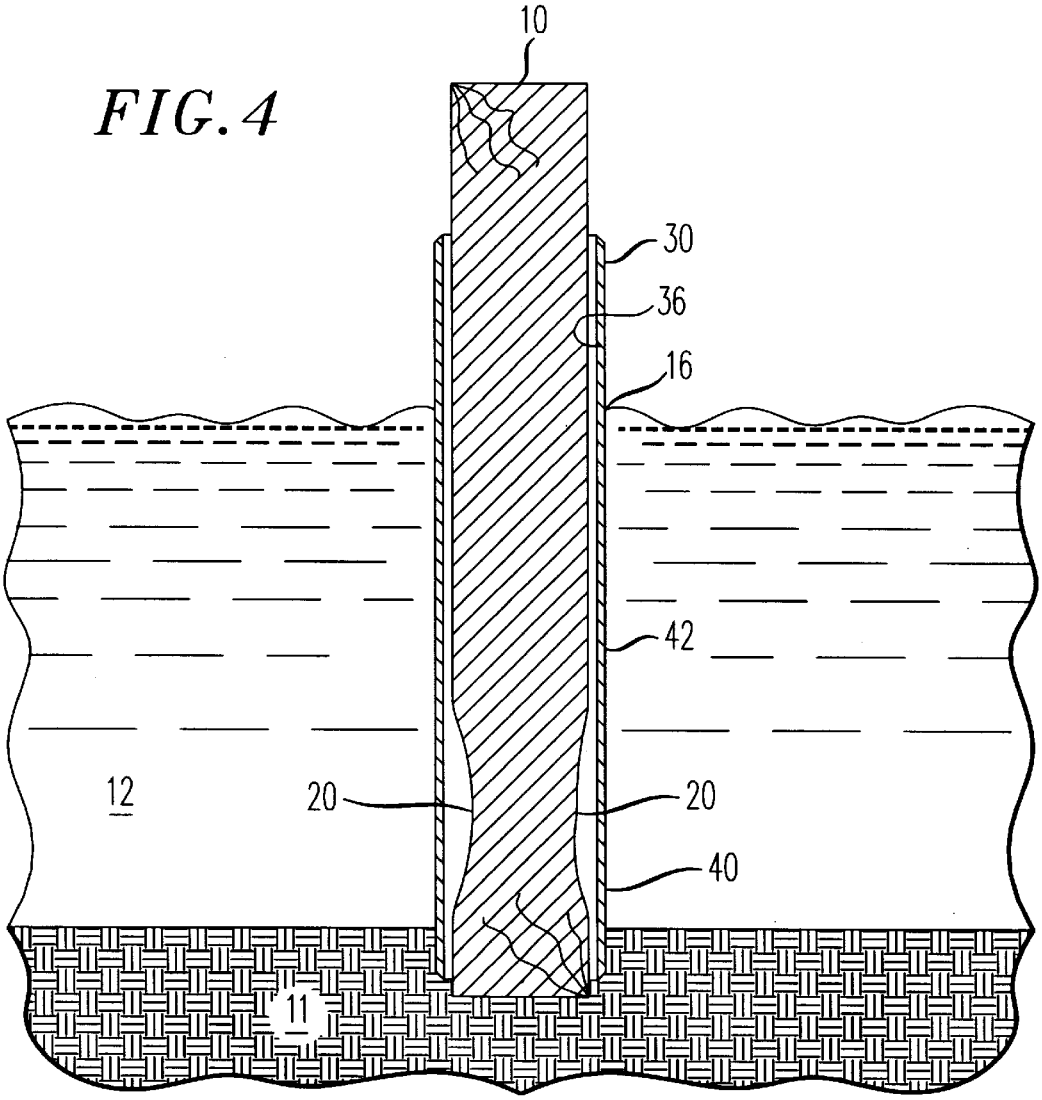
FIG. 4 is a side view along plane 3—3 of FIG. 3 of the manner in which to test a typical submerged timber or wooden pile in a wrapped condition for the efficacy of the wrapping of the wooden or timber pile.

FIG. 4 is an illustration of the wrap 10 identified in FIGS. 2 and 3 with various high and low water marks identified and with identification points utilized with the apparatus method and test kit of the present invention to determine the integrity of the wrap. This method and apparatus can be utilized either in an underwater mode or in an above water mode.

The first step in the procedure is to utilize a hypodermic needle having a relatively short needle member in order to penetrate the wrap and to draw off a sample of the alleged stagnant water trapped between the wrap 30 and the submerged timber or wooden pile 10. This sample should be drawn off at a location, dependent upon the geographical location of the submerged timber or pile where known infestation of marine microorganisms or marine borers occurs. Namely, this sample should be drawn off at a point at absolute low tide 40 or intermediate tide 42 or just before high tide 16. The sample thus drawn off, should be submitted to an oxygenation, ph, and temperature test to determine the capacity for the sample to support marine life. A typical and suitable test element for this test would be a rapid pulse probe such as manufactured by YSI Manufacturing.

If this oxygenation, temperature, ph test reveals readings indicative of the support of marine life, then and in that event, the second portion of the method apparatus and test kit would be utilized. This next step would be the insertion of an inert dye into the annular circumferential area 36 defined between the wrap and the submerged wood or timber pile and video imaging or observing of the wrap and piling to determine whether or not the dye egresses from the annular circumferential area between the wrap and the submerged timber or wood.

If the visual, video or photographic evidence indicates the release of the dye from between the wrap and the submerged timber or wooden piling, then it is reasonable to assume that the integrity of the wrap in protecting the submerged timber or wood piling has been violated and that infestation is present. This would therefore warrant the more evasive testing of taking a throughbore sample of the piling using conventional throughbore testing methods to determine the extent of the infestation. Naturally, the wrap of the piling could always be resealed as a result of the evasive throughbore testing, however, at this point in time as a result of the apparatus, method and test kit procedures, one would have to be extremely presumptive that the wrap had failed in its intended purpose and that the pile itself was in danger.

Figure 5:
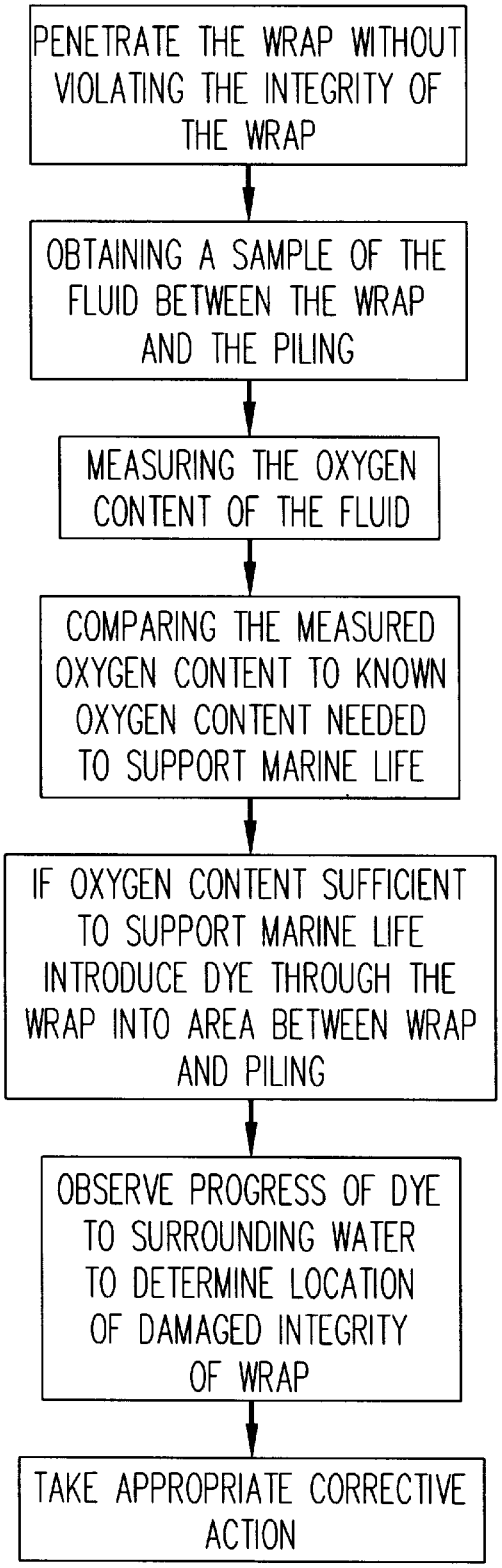
FIG. 5 is a block diagram of the method for testing for the efficacy of the wrapping of the typical timber or wooden pile in accordance with the present invention.

FIG. 5 is a block diagram of the test procedure for determining the efficacy of the wrapped wooden piling setting forth the steps to be taken.

While the present invention has been described in conjunction with the exemplary embodiment thereof, it will be understood that many modifications will be apparent to those of ordinary skill in the art and the application is intended to cover any adaptations or variations thereof. Therefore it is manifestly intended that the invention by only limited by the claims and equivalence thereof.

What is claimed:

1. A method for determining the efficacy of a wrap about a submerged wooden piling said method comprising:

penetrating the wrap about the piling without substantially violating the integrity of said wrap;

obtaining a sample of fluid positioned between said wrap and said piling;

measuring the oxygen content of said fluid sample;

comparing measured oxygen reading to known standards of readings for oxygen content sufficient to support viability of marine life;

introducing a fluid indicator into the annular space between said wrap and said submerged wooden piling in the event the oxygen reading is sufficient to support marine life;

visually identifying the egress of the visual indicator and its point of egress from the space between said wrap and said submerged wooden piling.

2. The method in accordance with claim 1 wherein additional steps can include:

measuring the sample for temperature and ph.

3. The method in accordance with claim 1 wherein said step of introducing a visual indicator comprises the introduction of a liquid dye.

4. An apparatus for testing the efficacy of a wrap about a submerged wooden piling comprising:

an invasive means for taking a sample of fluid between the wrap and the submerged wooden piling without violating the integrity of the wrap;

a meter for measuring the oxygen content of said sample;

a visual indicator for introduction into said space between said wrap and said submerged wooden piling in the event of an oxygen content reading sufficient to support the viability of marine life.

5. The apparatus in accordance with claim 4 wherein said invasive means comprises a syringe having a needle portion of a length and rigidity sufficient to penetrate said wrap.

6. The apparatus in accordance with claim 4 wherein said meter for measuring the oxygen content of said sample also measures the temperature and ph of said sample.

7. The apparatus in accordance with claim 4 which includes a comparison chart for determining whether or not the measured oxygen content will support marine life.

8. The apparatus in accordance with claim 4 wherein there is also included a visual indicator for introduction into said space between said wrap and said submerged wooden piling said visual indicator being a dye.

9. A test kit for testing the efficacy of a wrap about a submerged wooden piling comprising:

an invasive means for taking a sample of fluid between the wrap and the submerged wooden piling without violating the integrity of the wrap;

a meter for measuring the oxygen content of said sample;

a visual indicator for introduction into said space between said wrap and said submerged wooden piling in the event of an oxygen content reading sufficient to support the viability of marine life.

10. The test kit in accordance with claim 9 wherein said invasive means comprises a syringe having a needle portion of a length and rigidity sufficient to penetrate said wrap.

11. The test kit in accordance with claim 9 wherein said meter for measuring the oxygen content of said sample also measures the temperature and p of said sample.

12. The test kit in accordance with claim 9 which includes a comparison chart for determining whether or not the measured oxygen content will support marine life.

13. The test kit in accordance with claim 9 wherein there is also included a visual indicator for introduction into said space between said wrap and said submerged wooden piling said visual indicator being a dye.

* * * * *